US005280155A

United States Patent [19]

Ohtsuka et al.

[11] Patent Number: 5,280,155

[45] Date of Patent: Jan. 18, 1994

[54] IMAGE HEATER HAVING FILM GUIDE WITH PROJECTIONS

[75] Inventors: Yasumasa Ohtsuka; Shunji Nakamura; Kouichi Okuda, all of Yokohama; Yohji Tomoyuki, Ichikawa; Akira Hayakawa, Machida; Daizo Fukuzawa, Tokyo, all of Japan

[73] Assignee: Canon Kabushihi Kaisha, Tokyo, Japan

[21] Appl. No.: 913,923

[22] Filed: Jul. 17, 1992

[30] Foreign Application Priority Data

Jul. 19, 1991 [JP] Japan ..... 3-179545

[51] Int. Cl.[5] ..... G03G 15/20

[52] U.S. Cl. ..... 219/216; 355/285; 355/290

[58] Field of Search ..... 355/282, 285, 289, 290; 219/216, 469; 162/205, 206, 358.3, 358.5; 474/140

[56] References Cited

U.S. PATENT DOCUMENTS

| | | | |
|---|---|---|---|
| 3,811,828 | 5/1974 | Ohta et al. | 219/216 X |
| 4,287,021 | 9/1981 | Justus et al. | 162/358 |
| 4,801,975 | 1/1989 | Kano et al. | 355/218 |
| 5,119,143 | 6/1992 | Shimura | 355/289 |
| 5,132,744 | 7/1992 | Maruta et al. | 355/282 |
| 5,148,226 | 9/1992 | Setoriyama et al. | 355/290 |
| 5,149,941 | 9/1992 | Hirabayashi et al. | 219/216 |
| 5,162,634 | 11/1992 | Kusaka et al. | 219/216 |
| 5,210,579 | 5/1993 | Setoriyama et al. | 355/285 |

FOREIGN PATENT DOCUMENTS 0181723 5/1986 European Pat. Off. .

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image heating apparatus includes a heater and a film movable together with a recording material carrying an image so that the image on the recording material is heated by heat from the heater through the film. A guiding member guides a surface of the film that contacts the heater, and the guiding member has a surface with projections effective to reduce a contact area between the guiding surface and the film. In addition, a lubricant is supplied between the guiding surface and the film so as to reduce frictional contact.

8 Claims, 3 Drawing Sheets

IMAGE HEATER HAVING FILM GUIDE WITH PROJECTIONS

FIELD OF THE INVENTION AND RELATED ART

The present invention relates to an image heater of a film heating type in which a recording material is urged to a heater with a heat resistive film therebetween; a relative movement is imparted between the heater and the heat resistive film; and the heat is applied from the heater to the recording material through the heat resistive film.

A widely used heating apparatus for a recording material to fix an image, for example, is a heat roller type comprising a heating roller maintained at a predetermined temperature and a pressing roller press-contacted to the heating roller and having an elastic layer, in which the recording material is passed through a nip formed therebetween.

As for other types, there are a flash heating type, oven heating type, a plate heating type, a belt heating type, a high frequency heating type and so on.

U.S. Ser. No. 206,767 which has been assigned to the assignee of this application has proposed a film heating type image heating apparatus. This apparatus comprises a stationarily supported heater, a heat resistive film or sheet movable in contact with the heater and a pressing member for urging the recording material toward the heater wit the film therebetween, in which the heat is applied from the heater through the film to the recording material, by which the unfixed image carried on the surface of the recording material is heat-fixed thereon.

The image heating apparatus using the thin film and a quick response heater is advantageous in that the warming-up period from the start of the power supply to the heater to the reaching to a proper temperature, is short.

U.S. Ser. Nos. 712,532 and 712,573 which have been assigned to the assignee of this application have proposed further improved film heating type image heating apparatus, which comprises a guiding member for guiding an inside surface of the film.

Where the movement of the film is stabilized with the guiding member for guiding the film, the contact area between the guiding member and the film is large with the result of increased frictional resistance.

Where the frictional resistance is reduced by applying oil or grease between the heater and the film prior to the initial use of the apparatus, a problem that the guiding member and the film are stuck with each other while the film is not moved, with the result of incapability of the film movement, arises.

SUMMARY OF THE INVENTION

Accordingly, it is a principal object of the present invention to provide an image heating apparatus in which the frictional resistance between the film and the guide is reduced.

It is another object of the present invention to provide an image heating apparatus in which the sticking between the film and the guide is effectively prevented.

It is a further object of the present invention to provide an image heating apparatus comprising a heater, a film and a film guiding member, wherein the guiding member has a guiding surface having projections to reduce the contact area between the film and the guiding surface.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
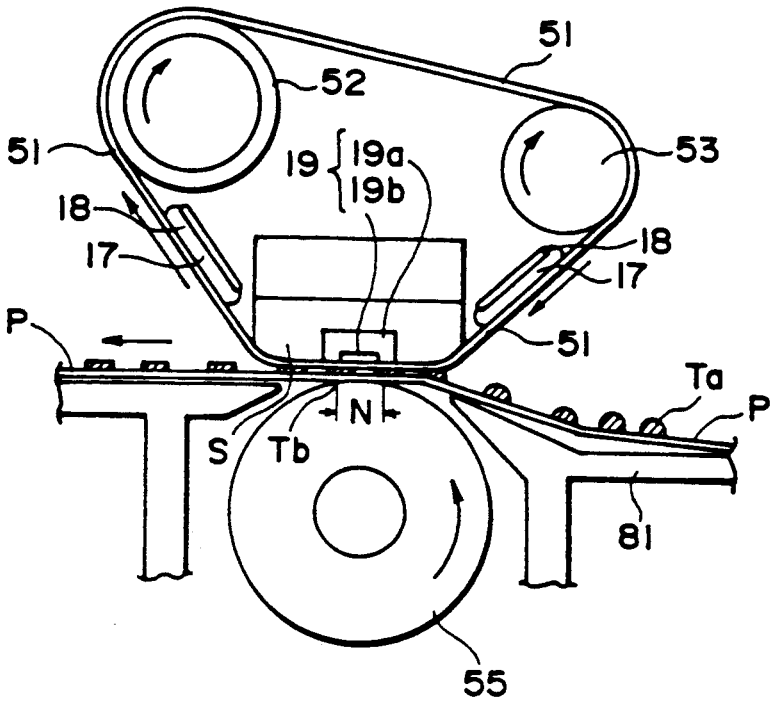
FIG. 1 is a longitudinal sectional view of a heating apparatus according to an embodiment of the present invention.

Referring to FIG. 1, there is shown an image fixing apparatus as an exemplary image heating apparatus according to an embodiment of the present invention. A fixing heater 19 comprises a base plate 19*a* of high thermal conductivity material such as alumina and a heat generating resistor pattern 19*b* made of silver-palladium or the like which generates heat upon electric power supply thereto, the pattern 19*b* being printed on the base plate 19*a*.

An endless belt film 51 is of heat resistive resin material such as polyimide, and the outer periphery thereof is coated with fluorine resin such as PFA or PTFE for the purpose of improving the parting property relative to the toner.

A roller 52 functions to drive the film 51. The surface thereof is coated with a rubber material to increase the friction coefficiency. A tension roller 53 functions to control tensions applied to the film at the front and/or rear side in the drawing by an unshown mechanism to prevent lateral shifting of the film 51.

A recording material P carries an unfixed powdery toner image Ta and is fed into a nip N, where the unfixed toner image Ta is heated and pressed into a fixed image Tb, and then is discharged. A pressing roller 55 comprises a core metal and a fluorine or silicone rubber wrapped therearound. An inlet guide 81 guides the recording material P into the nip N.

A guiding member 18 functions to guide the inside surface of the film 51 to stabilize the film travel.

Figure 2:
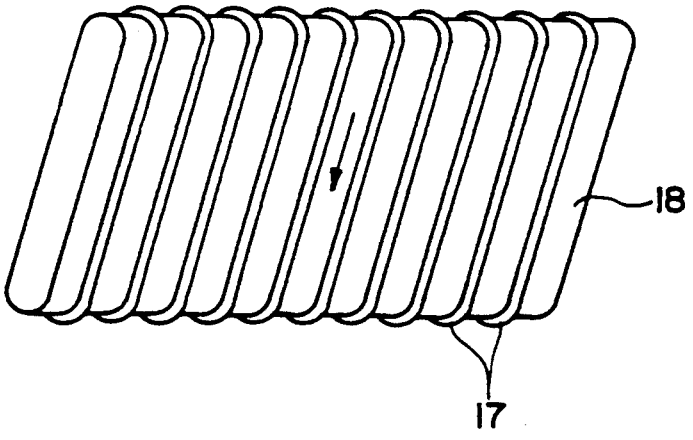
FIG. 2 is a perspective view of a guiding member used in the embodiment of the present invention.

FIG. 2 is a perspective view of the guiding member 18. As shown in this Figure, the guiding member comprises ribs 17 on the film guiding surface, the ribs 17 extending in the film guiding direction as indicated by an arrow in the Figure. By guiding the film with the surface having the pits and projections (ribs and grooves), the contact area between the film and the guiding member is reduced, so that the frictional resistance therebetween is reduced.

Figure 3:
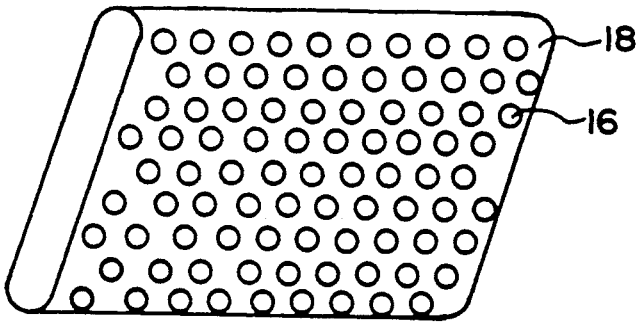
FIG. 3 is a perspective view of another example of the guiding member used in the embodiment of the present invention.

FIG. 3 shows another example of the guiding member usable with the present invention. The guiding member in FIG. 3 is provided projections 16 in the form of round island, by which the frictional resistance is reduced, too.

Figure 4:
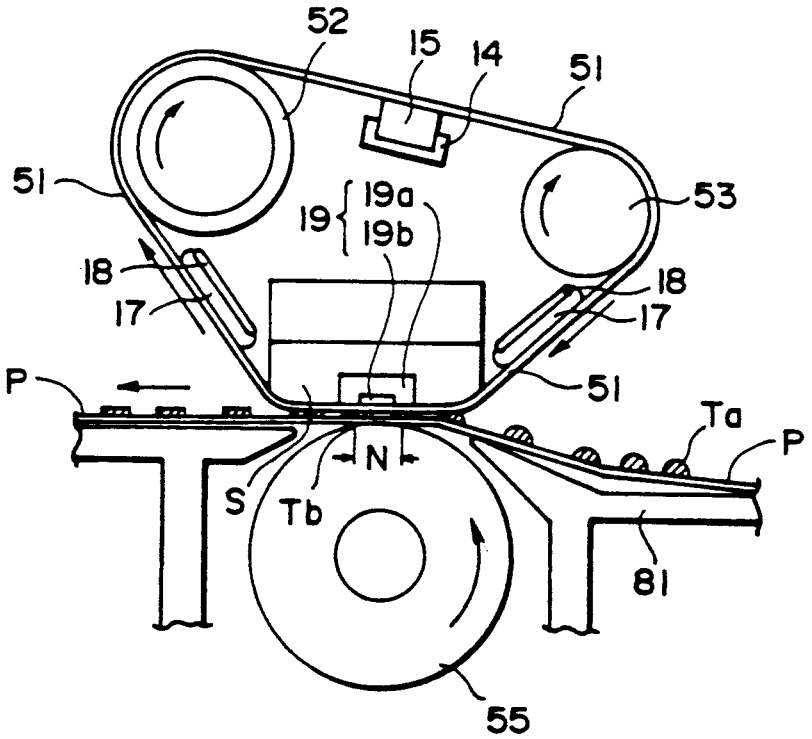
FIG. 4 is a sectional view of a heating apparatus according to another embodiment of the present invention.

FIG. 4 shows an apparatus according to a further embodiment of the present invention. In this embodiment, an oil applicator 15 is made of a felt material having a density of 0.15 g/cm$^3$, a length of 220 mm, a thickness of 10 mm and a width of 10 mm, which is impregnated with 1.5 cc of silicone oil (300 cs–10,000 cs). It is supported by a supporting member 14. Therefore, 10–100 g of the silicone oil is always present between the heater and the film, so that the frictional resistance between the film and the heater is reduced, by which the film travel is stabilized.

In this embodiment, the guiding member shown in FIG. 2 or 3 is used, and the sticking between the guiding member and the film stopping relative movement therebetween, can be prevented. In addition, 100,000 sheets were intermittently processed without the trouble of the slippage of the film, lateral shifting or other movement troubles. Furthermore, the friction with the heater surface is also reduced, so that the service life of the heater is extended.

The film drive is started when a predetermined period of time elapses after start of the power supply to the heater or when the heater reaches a predetermined temperature so that the viscosity of the oil sufficiently decreases. Therefore, the film does not stick to the heater.

Figure 5:
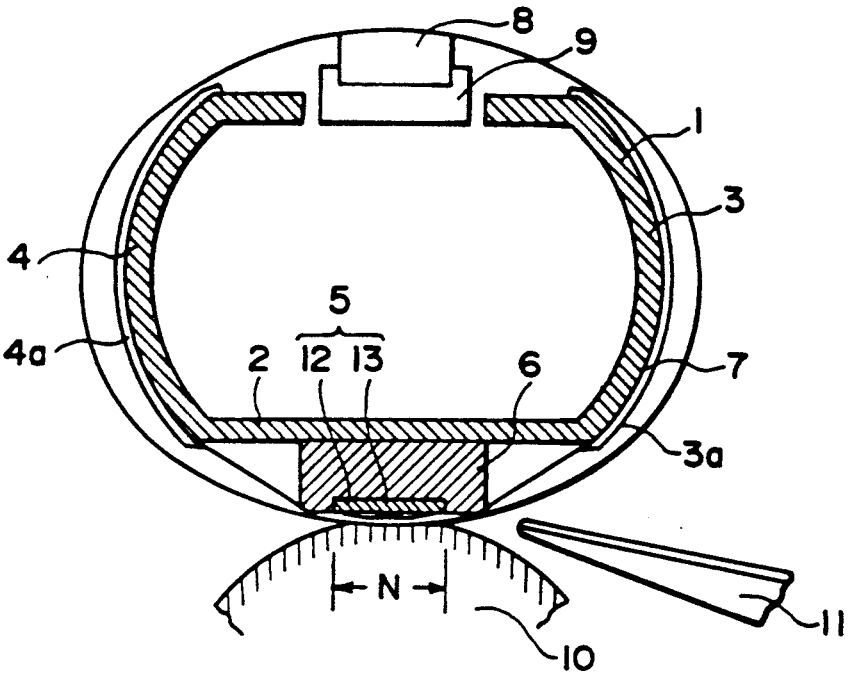
FIG. 5 is a sectional view of a heating apparatus according to a further embodiment of the present invention.

FIG. 5 shows another embodiment, in which the endless film is extended with slack, and the film drive is imparted by the pressing roller 10 without tension imparted to the film As compared with the foregoing embodiment, this embodiment does not use the driving roller, the tension roller or the like, and therefore, the structure is simplified and the size thereof is reduced. On the other hand, it involves a problem that when the friction increases between the inside surface of the film 7 and the heater 5, guiding members 3 and 4 or the insulating heater supporting member 6, the film 7 slips relative to the recording material (not shown), so that the toner image on the recording material is rubbed. In order to prevent the slippage, a felt 8 is contacted to the inside surface of the film to apply thereto a lubricant such as oil or grease in this embodiment. In order to prevent the inside surface of the film 7 with the oil or the like from sticking to the guiding members 3 and 4, ribs 3*a* and 4*a* are provided. The felt 8 is supported by a supporting member 9.

In FIG. 5, an elongated stay 1 functions as an inside guiding member for the film 7 which will be described hereinafter and a supporting and reinforcing member for the heater 5 and the heater supporting member 6, which will be described hereinafter.

The stay 1 comprises a flat bottom surface portion 2 which is extended in the horizontal direction, a front guide plate 3 integrally extended from longitudinal end portions of the bottom surface portion 2 and which is outwardly arcuated, a rear guide member 4, and a pair of horizontal lugs (not shown) projected outwardly from the left and right end portions of the bottom surface portion 2.

In this embodiment, the linear heater (heating element) 5 has a structure shown in FIG. 2. More particularly it is in the form of a heater base plate 12, a heater supporting member 6 which extends in a lateral direction of the fixing film (perpendicular to the direction of the travel of the fixing film 7) and which has a rigidity, high heat resistivity and insulating property, and a heat generating element 13 mounted to the bottom surface of the heater supporting member 6 along the longitudinal direction thereof. The heat generating element 13 extends substantially on a longitudinal center line of the heater base plate 12 and is provided by applying electric resistance material such as Ag/Pd (silver palladium) or the like by screen printing into a thickness of approximately 10 microns and a width of 1–3 mm, and by coating it with a glass layer for insulation and protection purposes. A further coating of PFA or PTFE may be provided to reduce the friction with the fixing film 7. The heater supporting member 6 may be made of highly heat resistive resin such as PPS (polyphenylene sulfide), PAI (polyamide imide), PI (polyimide), PEEK (polyether ether ketone), liquid crystal polymer material or the like, or of a composite material of the above mentioned resin and ceramic, metal or glass material.

An endless film 7 is made of heat resistive material and is extended around the stay 1 including the heater 5 and the heater supporting member 6. The relation between the internal circumferential length of the endless film 7 and the external circumferential length of the stay 1 including the heater 5 and the heater supporting member 6 is such that the internal circumferential length of the film 7 is larger by approx. 3 mm, for example, and therefore, the film 7 is extended loosely around the stay 1 including the heater 5 and the heater supporting member 6. In order to reduce the thermal capacity to improve the quick start nature, the total thickness of the film 7 is not more than 100 microns, preferably not more than 40 microns and not less than 20 microns. It may be of a single layer structure of a material having a heat resistivity, parting property, high mechanical strength and durability, or it may be in the form of a multi-layer film.

A film pressing roller (or back-up roller) 10 is cooperative with the heater 5 to form a nip therebetween with the film 7 interposed, and the pressing roller 10 functions to drive the film. It comprises a central shaft and a roller portion on the shaft, which is made of rubber elastic material having a good parting property, such as silicone rubber. The left and right ends of the central shaft are rotatably supported by unshown bearings. The ribs 3*a* and 4*a* of the guiding members 3 and 4 have a width of 1–3 mm, a height of 0.5–1 mm with a space of 10–20 mm, so that the contact between the guiding member and the film is prevented in the non-rib portions by the rigidity of the film itself. When the film is not moved, the oil is not easily expanded between the inside surface of the film and the guiding member, and therefore, they are not stuck each other.

The lubricant may be a silicone oil (KF96-H, 300 cs–10,000 cs. available from Shinetsu Kagaku Kabushiki Kaisha, Japan), fluorinated oil (such as Demnum s-200, available from Daikin Kogyo Kabushiki Kaisha, Japan), fluorine grease (Demnum LR200 or L65, available from Daikin Kogyo Kabushiki Kaisha, Japan; Molycoat HP300, available from Dow Corning). These materials have sufficient heat resistivity so that it is not easily dissolved even if heated by the surface of the heater, and therefore, the stabilized sliding property can be provided for a long period of time.

The surface structure of the guiding portion is not limited to the rib structure, but may be a boss-structure.

In the embodiment of FIGS. 4 and 5, the lubricant is applied by felt (but the lubricant may be applied during the assembling of the apparatus, or the lubricant may be supplied periodically by a serviceman).

Figure 6:
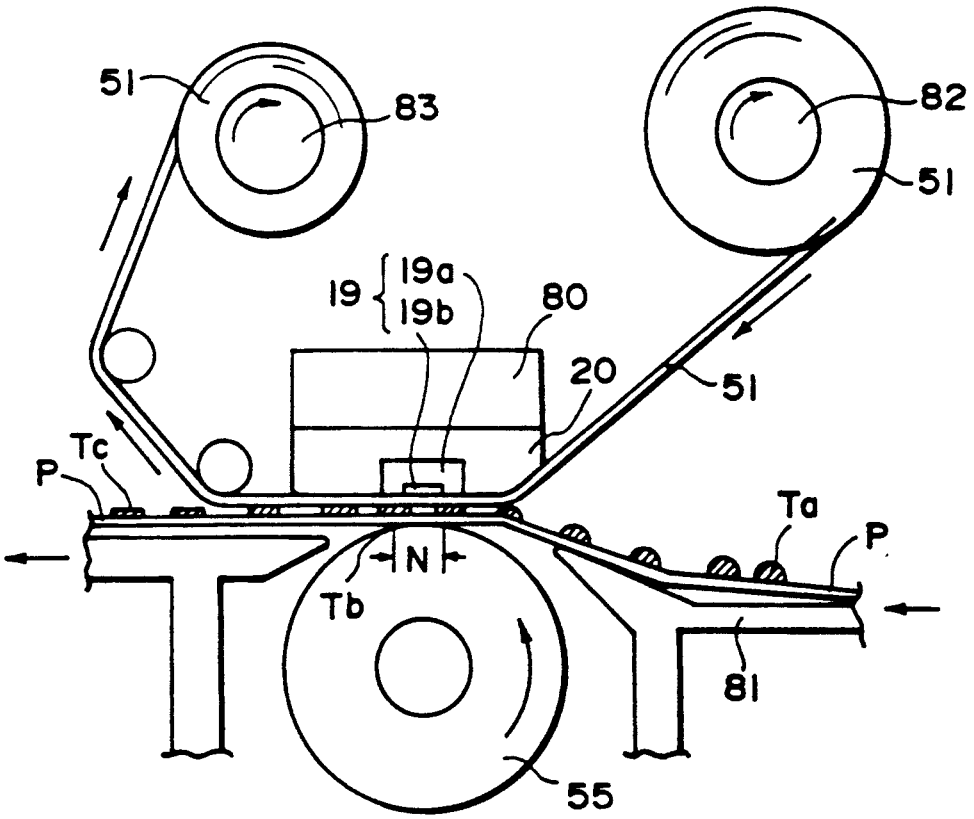
FIG. 6 is a sectional view of an image heating apparatus according to a yet further embodiment of the present invention.

The fixing film has been described as in the form of an endless belt, but it may be a non-endless belt, as shown in FIG. 6.

As described in the foregoing, according to the present invention, the frictional resistance between the film and the guiding member, can be reduced.

When the lubricant is applied to the inside surface of the film, the film is effectively prevented from sticking to the guiding member or members.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater;

a resin film having a resin material surface layer movable with a recording material having an image, said image contacting said resin material surface layer, wherein the image on the recording material is heated by heat generated by said heater, said heat passing from said heater through said film;

a lubricant disposed between said resin film and said heater; and a guiding member for guiding a surface of said resin film as is in contact with said heater;

wherein said guiding member has a guiding surface with projections effective to reduce a contact area between the guiding surface and said resin film.

2. An apparatus according to claim 1, wherein a lubricant is supplied between the guiding surface and said film.

3. An apparatus according to claim 1, wherein said guiding surface is provided with a plurality of ribs extending in a movement direction of said film.

4. An apparatus according to claim 1, wherein said film is slidable on said guiding surface.

5. An apparatus according to claim 1, wherein said film is in the form of an endless belt and is extended around both of said heater and said guiding member with slackness.

6. An apparatus according to claim 5, further comprising a rotatable member cooperative with said heater to form a nip therebetween with said film interposed therebetween, and said film rotates following rotation of said rotatable member.

7. An apparatus according to claim 1, wherein said guiding member is provided at each of upstream side and downstream side of said heater with respect to a movement direction of said film.

8. An apparatus according to claim 1, wherein said heater is stationary, and said film slides on said heater.

* * * * *

UNITED STATES PATENT AND TRADEMARK OFFICE

CERTIFICATE OF CORRECTION

PATENT NO. : 5,280,155

DATED : January 18, 1994

INVENTOR(S) : YASUMASA OHTSUKA, ET AL.

It is certified that error appears in the above-identified patent and that said Letters Patent is hereby corrected as shown below:

ON TITLE PAGE item [73] Assignee: "Canon Kabushihi Kaisha" should read --Canon Kabushiki Kaisha--.

COLUMN 1

Line 30, "wit" should read --with--.

COLUMN 2

Line 68, "provided" should read --provided with--.

COLUMN 3

Line 32, "film" should read --film.--.
Line 56, "plate 3" should read --member 3--.

COLUMN 4

Line 51, "stuck" should read --stuck to--.

UNITED STATES PATENT AND TRADEMARK OFFICE

CERTIFICATE OF CORRECTION

PATENT NO. : 5,280,155

DATED : January 18, 1994

INVENTOR(S) : YASUMASA OHTSUKA, ET AL.

It is certified that error appears in the above-identified patent and that said Letters Patent is hereby corrected as shown below:

COLUMN 4

Line 53, "cs." should read --cs,--.

Signed and Sealed this

Ninth Day of August, 1994

Bruce Lehman

*Attest:*

BRUCE LEHMAN

*Attesting Officer*

*Commissioner of Patents and Trademarks*